US008626018B2

(12) United States Patent
Ogawa et al.

(10) Patent No.: US 8,626,018 B2
(45) Date of Patent: Jan. 7, 2014

(54) FIXING UNIT AND IMAGE FORMING APPARATUS

(75) Inventors: Tadashi Ogawa, Tokyo (JP); Masanao Ehara, Kanagawa (JP); Satoshi Ueno, Tokyo (JP); Hiroshi Seo, Kanagawa (JP); Takahiro Imada, Kanagawa (JP); Takamasa Hase, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 367 days.

(21) Appl. No.: 13/041,703

(22) Filed: Mar. 7, 2011

(65) Prior Publication Data

US 2011/0229178 A1 Sep. 22, 2011

(30) Foreign Application Priority Data

Mar. 16, 2010 (JP) ..... 2010-058951

(51) Int. Cl.
*G03G 15/20* (2006.01)
*G03G 15/16* (2006.01)
*G03G 15/00* (2006.01)

(52) U.S. Cl.
USPC ..... 399/67; 399/122; 399/328; 399/406

(58) Field of Classification Search
USPC ..... 399/67, 122, 406
See application file for complete search history.

(56) References Cited

U.S. PATENT DOCUMENTS 5,832,354 A 11/1998 Kouno et al.
5,915,147 A 6/1999 Kouno et al.
6,219,520 B1 4/2001 Ehara
6,246,860 B1 * 6/2001 Ohmichi ..... 399/406
6,628,916 B2 9/2003 Yasui et al.
6,636,709 B2 10/2003 Furukawa et al.
6,778,790 B2 8/2004 Yoshinaga et al.
6,785,505 B2 8/2004 Yasui et al.
6,807,386 B2 10/2004 Yasui et al.

(Continued)

FOREIGN PATENT DOCUMENTS

JP 10-282828 10/1998
JP 2005-17477 1/2005

(Continued)

OTHER PUBLICATIONS

U.S. Appl. No. 13/026,945, filed Feb. 14, 2011, Kenji Ishii, et al.

(Continued)

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A fixing unit includes a fixing member to fuse a toner image on a recording medium on the recording medium; a pressure member to press against the fixing member to define a first nip between the fixing member and the pressure member through which the recording medium is transported; a shifting unit to move the pressure member relative to the fixing member to increase or decrease a pressure of the first nip; a curling correction unit disposed downstream from the first nip in a transport direction of the recording medium that imparts a second curling direction to the recording medium; and a variable setting unit operatively connected to the curling correction unit to variably set an amount of the second curling direction to the recording medium by the curling correction unit depending on the first nip pressure increased or decreased by the shifting unit.

7 Claims, 4 Drawing Sheets

(56) References Cited

U.S. PATENT DOCUMENTS

| | | | | |
|---|---|---|---|---|
| 6,881,927 | B2 | 4/2005 | Yoshinaga et al. | |
| 6,892,044 | B2 | 5/2005 | Yasui et al. | |
| 7,022,944 | B2 | 4/2006 | Yoshinaga et al. | |
| 7,136,615 | B2 * | 11/2006 | Oohara et al. | 399/329 |
| 7,266,336 | B2 | 9/2007 | Ueno et al. | |
| 7,298,981 | B2 * | 11/2007 | Oohara et al. | 399/45 |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,546,049 | B2 | 6/2009 | Ehara et al. | |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,742,714 | B2 | 6/2010 | Shinshi et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 2004/0042831 | A1 * | 3/2004 | Burnett et al. | 399/406 |
| 2005/0260005 | A1 * | 11/2005 | Vanbortel et al. | 399/45 |
| 2006/0029411 | A1 | 2/2006 | Ishii et al. | |
| 2006/0188291 | A1 * | 8/2006 | Kawakami et al. | 399/167 |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0110487 | A1 * | 5/2007 | Kim et al. | 399/328 |
| 2007/0280754 | A1 | 12/2007 | Ogawa et al. | |
| 2008/0025773 | A1 | 1/2008 | Ito et al. | |
| 2008/0063443 | A1 | 3/2008 | Yoshinaga et al. | |
| 2008/0267650 | A1 * | 10/2008 | Kim | 399/68 |
| 2008/0317532 | A1 | 12/2008 | Ehara et al. | |
| 2009/0035033 | A1 * | 2/2009 | Chang | 399/328 |
| 2009/0060550 | A1 | 3/2009 | Seo | |
| 2009/0123201 | A1 | 5/2009 | Ehara et al. | |
| 2009/0148204 | A1 | 6/2009 | Yoshinaga et al. | |
| 2009/0148205 | A1 | 6/2009 | Seo et al. | |
| 2009/0190983 | A1 * | 7/2009 | Yamamoto et al. | 399/406 |
| 2009/0245897 | A1 | 10/2009 | Seo et al. | |
| 2009/0257801 | A1 * | 10/2009 | Miyoshi et al. | 399/406 |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0135708 | A1 * | 6/2010 | Goto | 399/406 |
| 2010/0150635 | A1 * | 6/2010 | Tanaka et al. | 399/406 |
| 2010/0158553 | A1 | 6/2010 | Ueno | |
| 2010/0158588 | A1 * | 6/2010 | Kim et al. | 399/331 |
| 2010/0272458 | A1 * | 10/2010 | Yoshikawa | 399/68 |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |

FOREIGN PATENT DOCUMENTS

| | | |
|---|---|---|
| JP | 2007-79160 | 3/2007 |
| JP | 2009-7079 | 1/2009 |
| JP | 4579600 | 9/2010 |

OTHER PUBLICATIONS

U.S. Appl. No. 12/876,589, filed Sep. 7, 2010, Yoshiki Yamaguchi, et al.
U.S. Appl. No. 12/881,862, filed Sep. 14, 2010, Takamasa Hase, et al.
U.S. Appl. No. 12/881,547, filed Sep. 14, 2010, Naoki Iwaya, et al.
U.S. Appl. No. 12/878,480, filed Sep. 9, 2010, Yoshiki Yamaguchi, et al.
U.S. Appl. No. 12/893,361, filed Sep. 29, 2010, Kenichi Hasegawa, et al.
U.S. Appl. No. 12/878,557, filed Sep. 9, 2010, Akira Shinshi, et al.
U.S. Appl. No. 12/946,276, filed Nov. 15, 2010, Yoshiki Yamaguchi, et al.
U.S. Appl. No. 12/946,347, filed Nov. 15, 2010, Kenji Ishii, et al.

* cited by examiner

FIXING UNIT AND IMAGE FORMING APPARATUS

CROSS-REFERENCE TO RELATED APPLICATIONS

This application claims priority to Japanese Patent Application No. 2010-058951, filed on Mar. 16, 2010 in the Japan Patent Office, which is incorporated by reference herein in its entirety.

BACKGROUND OF THE INVENTION

1. Field of the Invention

The present invention relates to an image forming apparatus such as a copier, a printer, a facsimile machine, or a multi-functional apparatus having some combination of these functions, and a fixing unit disposed in the image forming apparatus, and more particularly, to an image forming apparatus having a fixing unit to increase and decrease a nip pressure between a fixing member and a pressure member.

2. Description of the Background Art

Conventionally, image forming apparatuses such as copiers and printers employ a fixing unit having a fixing member and a pressure member to conduct a fixing process, in which a fixing nip is set between the fixing member and the pressure member with a pressurized condition, and a recording medium is transported through the fixing nip for conducting a fixing process. For example, JP-2007-79160-A, JP-H10-282828-A, and JP-2006-23427-A disclose such configuration.

Furthermore, it is known that the size or extent of the nip width and the nip pressure at the fixing nip in the fixing unit greatly affects fixing performance. Further, because the recording medium receives relatively greater pressure and heat at the fixing nip position, after the recording medium exits the fixing nip, it is known that the recording medium sometimes experiences curling such as back curling. Specifically, the recording medium may be curved or warped along a curvature of the pressure member, and curved or warped to that side of the recording medium on which no image is formed (that is, the pressure member side). A technique is known for correcting such curling by, for example, correcting, canceling, or offsetting such curling, in which a second curling is applied to the recording medium in a direction opposite the direction of the first curling of the recording medium exiting the fixing nip.

Further, JP-2006-23427-A discloses another technology or method to correct curling of the recording medium involving a curling correction unit equipped with a curling guide. Depending on the thickness or other properties of the recording medium transported to the fixing nip, an angle of the de-curling guide is varied to provide effective curling correction.

In such conventional fixing units, depending on the type of recording media and an image area ratio of the output image, the pressure at a fixing nip (nip pressure) is adjusted so that a good fused image can be obtained consistently. However, the amount of curling of the recording medium may fluctuate because the nip pressure varies in response to the recording medium. If the fixing nip pressure is increased, the recording medium might curl more. In such a case, jamming of recording medium (or sheet jamming) may occur along a transportation route through which the recording medium is transported after the fixing nip, thus degrading image quality.

SUMMARY OF THE INVENTION

In one aspect of the present a fixing unit is devised. The fixing unit includes a fixing member to fuse a toner image on a recording medium by heating and melting the toner image on the recording medium; a pressure member to press against the fixing member, to define a first nip, as a fixing nip, between the fixing member and the pressure member through which the recording medium is transported; a shifting unit to move the pressure member relative to the fixing member to increase or decrease a pressure of the first nip; a curling correction unit disposed downstream from the first nip in a transport direction of the recording medium that imparts a second curling direction to the recording medium, opposite of a first curling direction of the recording medium exiting the first nip; and a variable setting unit operatively connected to the curling correction unit to variably set an amount of the second curling direction to be applied to the recording medium by the curling correction unit depending on the first nip pressure increased or decreased by the shifting unit.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
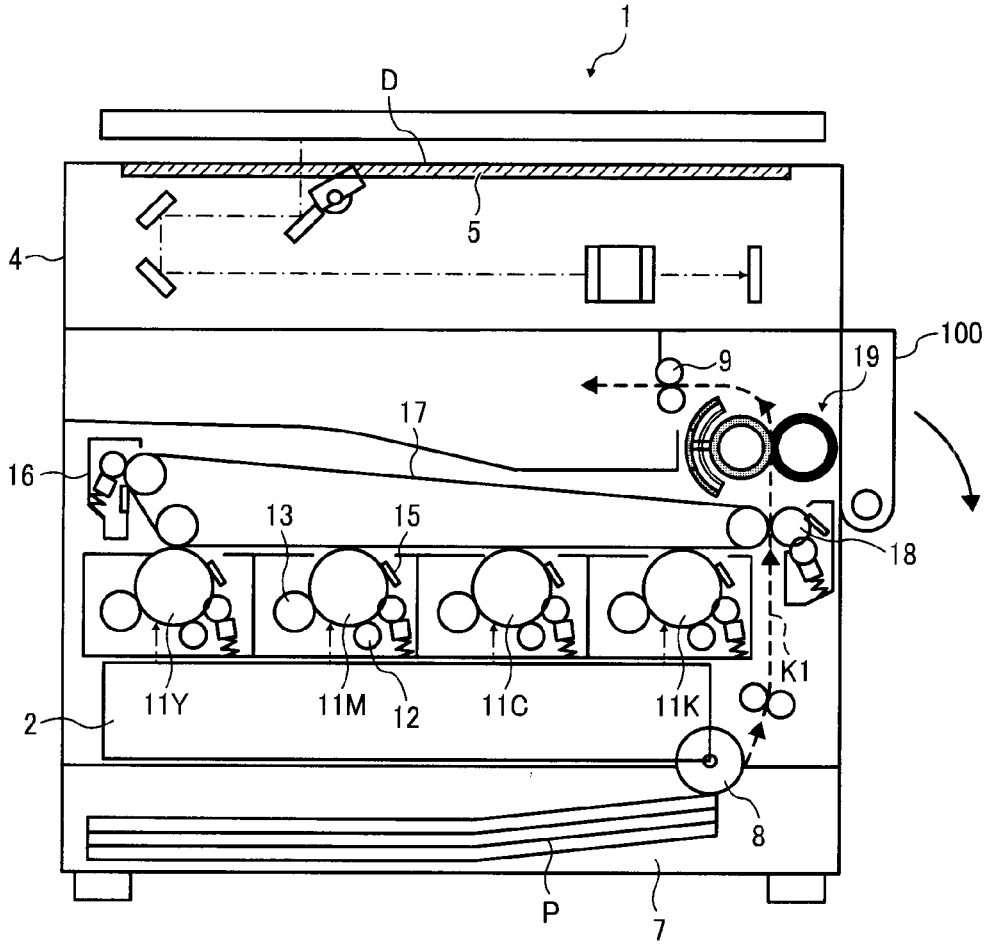
FIG. 1 shows an overall schematic configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms “a”, “an” and “the” are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner and achieve a similar result. Referring now to the drawings, an image forming apparatus according to example embodiment is described hereinafter.

A description is now given of an overall configuration and operation in an image forming apparatus with reference to FIG. 1. As shown in FIG. 1, an image forming apparatus 1, which may be used as a tandem type color copier, includes a writing unit 2, a document scanner 4, a sheet feeder 7, photoconductors 11Y, 11M, 11C, 11K, a charger 12, a development unit 13, a cleaning unit 15, an intermediate transfer belt cleaning unit 16, an intermediate transfer belt 17, a secondary transfer roller 18, and a fixing unit 19, for example. The writing unit 2 emits a laser beam based on input image information or data. The document scanner 4 scans image information or data of document D. The sheet feeder 77 stores recording medium P such as transfer sheets. The photoconductors 11Y, 11M, 11C, 11K having drum shape are used to form toner images of yellow, magenta, cyan, black, respectively, and the photoconductor may be a photoconductor drum. The charger 12 charges the surface of the photoconductors 11Y, 11M, 11C, 11K. The development unit 13 develops an electrostatic latent image formed on each of the photoconductors 11Y, 11M, 11C, 11K. The cleaning unit 15 recovers non-transferred toner from each of the photoconductors 11Y, 11M, 11C, 11K. The intermediate transfer belt cleaning unit 16 cleans the intermediate transfer belt 17. The intermediate transfer belt 17 is transferred with a plurality of toner images as superimposed image thereon. The secondary transfer roller 18 transfers a color image formed on the intermediate transfer belt 17 to the recording medium P. The fixing unit 19 fuses toner image (or non-fused image) on the recording medium P using, for example, an electromagnetic induction heating system.

Hereinafter, a description is given of a color image forming operation in the image forming apparatus 1. At first, the document scanner 4 optically scans image information (or data) of document D placed on a contact glass 5. Specifically, the document scanner 4 irradiates light emit from a lamp to image of the document D on the contact glass 5 to scan the document D. Then, light reflected at the document D is focused at a color sensor via mirrors and a lens. Color image information (or data) of the document D read by the color sensor for each of color lights such as RGB (red, green, blue) components is then converted to an electrical image signal.

Further, based on image signal of RGB components, an image processing unit conducts a color conversion processing, a color correction processing, a space frequency correction processing, or the like to obtain color image information or data of yellow, magenta, cyan, black. Then, image information or data of each of yellow, magenta, cyan, black is transmitted to the writing unit 2. Then, the writing unit 2 emits a laser beam (exposing light) corresponding to image information or data of each color to each of the photoconductors 11Y, 11M, 11C, 11K.

Meanwhile, each of the photoconductors 11Y, 11M, 11C, 11K rotates in a clockwise direction in FIG. 1. Then, the surface of the photoconductors 11Y, 11M, 11C, 11K is uniformly charged by the charger 12, disposed opposite the photoconductor (charging process), by which a charging potential is formed on each of the photoconductors 11Y, 11M, 11C, 11K. Then, the charged surface of the photoconductors 11Y, 11M, 11C, 11K comes to an irradiation position of each of laser beams.

In the writing unit 2, laser beams, corresponding to image signal of color, emit from four light sources, and then each of laser beams passes through light path, differently set for each of color components of yellow, magenta, cyan, black (exposure process).

A laser beam corresponding to yellow component is irradiated to the surface of the photoconductor 11Y. When the laser beam of yellow component is irradiated, the laser beam is being scanned along a rotation axis direction (main scanning direction) of the photoconductor 11Y by a polygon mirror rotating at a high speed. With such process, an electrostatic latent image corresponding to yellow component is formed on the surface of photoconductor 11Y charged by the charger 12.

Similarly, an electrostatic latent image corresponding to magenta component is formed on the surface of photoconductor 11M charged by the charger 12 by irradiating a laser beam corresponding to magenta component. Similarly, an electrostatic latent image corresponding to cyan component is formed on the surface of photoconductor 11C charged by the charger 12 by irradiating a laser beam corresponding to cyan component. Similarly, an electrostatic latent image corresponding to black component is formed on the surface of photoconductor 11K charged by the charger 12 by irradiating a laser beam corresponding to black component.

Then, the surface of photoconductors 11Y, 11M, 11C, 11K having the formed electrostatic latent image comes to a position facing the development unit 13. Then, the development unit 13 supplies toner of each color onto the photoconductors 11Y, 11M, 11C, 11K to develop the electrostatic latent image on the photoconductors 11Y, 11M, 11C, 11K (development process).

After the development process, the surface of the photoconductors 11Y, 11M, 11C, 11K comes to a position facing the intermediate transfer belt 17. At such position, a transfer bias roller is disposed inside the intermediate transfer belt 17 while contacting the inner face of the intermediate transfer belt 17. Toner images formed on the photoconductors 11Y, 11M, 11C, 11K are sequentially transferred on the intermediate transfer belt 17 at a position of the transfer bias roller as superimposed image (primary transfer process).

After the primary transfer process, the surface of the photoconductors 11Y, 11M, 11C, 11K comes to a position facing the cleaning unit 15. The cleaning unit 15 recovers non-transferred toner remaining on the photoconductors 11Y, 11M, 11C, 11K (cleaning process). After the cleaning process, the surface of the photoconductors 11Y, 11M, 11C, 11K passes through a position facing a decharger, by which an image forming process for the photoconductors 11Y, 11M, 11C, 11K ends.

Furthermore, the intermediate transfer belt 17 having the superimposed-and-transferred toner image comes to a position facing the secondary transfer roller 18. At such position, the secondary transfer roller 18 and a secondary transfer backup roller sandwich the intermediate transfer belt 17 to set a secondary transfer nip. Toner images, consisting of four superimposed colors and formed on the intermediate transfer belt 17, are transferred to the recording medium P transported to the position of secondary transfer nip (secondary transfer process). In such secondary transfer process, some toner may remain on the intermediate transfer belt 17 as non-transferred toner, which is not transferred to the recording medium P. After the secondary transfer process, the intermediate transfer belt 17 comes to a position facing the intermediate transfer belt cleaning unit 16. Then, non-transferred toner remaining on the intermediate transfer belt 17 is recovered at such position. Then, a transfer process conducted with the intermediate transfer belt 17 ends.

The recording medium P, transported to the position of secondary transfer nip, is transported from the sheet feeder 7 disposed at a under part of the image forming apparatus 1 via a transportation route K1 disposed with a sheet feed roller 8, a registration roller, or the like. Specifically, the sheet feeder 7 stores and stacks a plurality of sheets as recording medium P. When the sheet feed roller 8 is rotated by driving force in a counter-clockwise direction in FIG. 1, an uppermost sheet is fed to the transportation route K1 as recording medium P.

The recording medium P transported to the transportation route K1 is temporarily stopped at a position of a roller nip of registration roller by stopping the rotation of registration roller. Then, the registration roller is rotated at a given timing synchronized with formation of a color image on the intermediate transfer belt 17 to feed the recording medium P to the secondary transfer nip. Then, a desired color image is transferred on the recording medium P.

After such process, the recording medium P having the color image transferred at the position of the secondary transfer nip is transported to the fixing unit 19. In the fixing unit 19, heat and pressure are applied to the recording medium P using a fixing roller and a pressure roller, by which the transferred color image is fused on the recording medium P. After the fixing process, the recording medium P is ejected outside of the image forming apparatus 1 using a sheet ejection roller 9 as an output image recorded sheet in a direction shown by an dotted arrow, by which an image forming operation ends.

Figure 2:
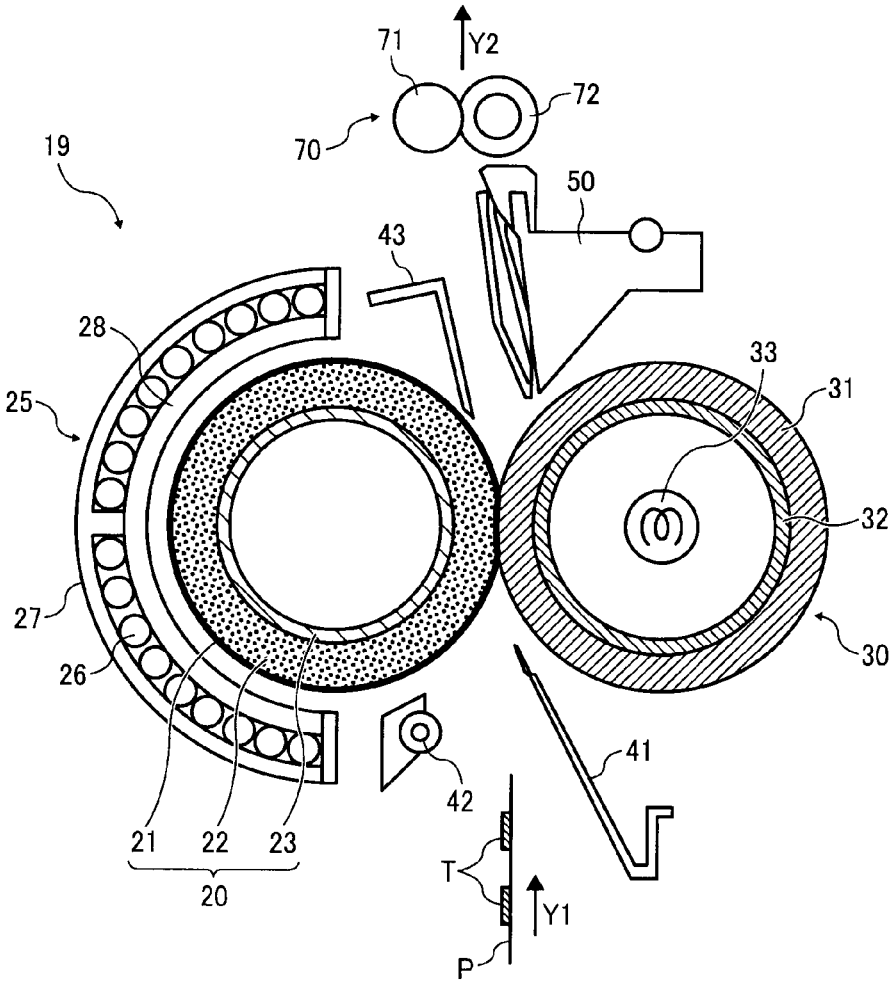
FIG. 2 shows a cross-sectional view of a fixing unit employed in the image forming apparatus of FIG. 1.

A description is now given of configuration and operation of the fixing unit 19 disposed in the image forming apparatus 1. As shown in FIG. 2, the fixing unit 19 may include an induction heating unit 25 such as magnetic flux generator, a fixing roller 20 used as a fixing member and facing the induction heating unit 25, a pressure roller 30 used as pressure member which can be pressingly contacted against the fixing roller 20, an entry guide 41 such as plate, a roll 42, a separator 43 such as plate, a guide 50, and a curling correction unit 70, for example. The fixing roller 20 and the pressure roller 30 may form a first nip therebetween, which is a fixing nip set between the fixing roller 20 and the pressure roller 30.

The fixing roller 20, used as the fixing member, may include a metal core 23, an insulation elastic layer 22, and a sleeve layer 21. The metal core 23 may be made of iron, stainless steel or the like. The insulation elastic layer 22 and the sleeve layer 21, made of resin such as foamed silicone rubber, are sequentially overlaid on the metal core 23, and the fixing roller 20 may have an outside diameter such as 40 mm or so. The sleeve layer 21 may include a base layer, a first anti-oxidation layer, a heating layer, a second anti-oxidation layer, an elastic layer, and a separation layer from an inner side to an outer side of the fixing roller 20. As such, the sleeve layer 21 may have a multi-layered structure sequentially overlaying multiple layers.

Specifically, the base layer may be made of stainless having a thickness of 40 μm or so. The first anti-oxidation layer and the second anti-oxidation layer may be formed by a strike coating of nickel with a thickness of 1 μm or less. The heating layer may be made of cupper having a thickness of 10 μm or so. The elastic layer may be made of a silicone rubber having a thickness of 150 μm or so. The separation layer may be made of PFA (tetrafluoroethylene/perfluoroalkyl/vinyl ether copolymer) having a thickness of 30 μm or so. The fixing roller 20, configured as such, can be heated when the heating layer of the sleeve layer 21 is heated by the induction heating unit 25 using electromagnetic induction by magnetic flux generated by the induction heating unit 25.

Further, the configuration of the fixing roller 20 is not limited to the above configuration. For example, the sleeve layer 21 may not be adhered to the insulation elastic layer 22 of the fixing roller 20 (fixing-assist roller), but may be prepared as a different member. If the sleeve layer 21 (or fixing sleeve) is prepared as a different member as such, a member to prevent movement of the sleeve layer 21 in a width direction (or thrust direction) during a fixing operation may be preferably disposed.

In such fixing unit 19, at a position facing the fixing roller 20 from an upstream of the fixing nip (upstream of transport direction), a plurality of the rolls 42 may be disposed in a width direction, and each of the rolls 42 guides the recording medium P to the fixing nip. The outer periphery of the roll 42 may be formed as a saw like shape to prevent on occurrence of scratching of image even if the roll 42 contacts non-fused image on the recording medium P.

Further, at a position facing the fixing roller 20 and a downstream from the fixing nip (downstream of transport direction), the separator 43 such as plate may be disposed. The separator 43 is used to prevent an absorbed and/or wound condition of the recording medium P onto the fixing roller 20 after the recording medium P is exiting the fixing nip after the fixing process. If the recording medium P is to absorb on the fixing roller 20 after the fixing process, the separator 43 may interfere the front edge of recording medium P to forcibly separate the recording medium P from the fixing roller 20. Further, a thermopile (non-contact type temperature sensor) or a thermistor (contact type temperature sensor) may be disposed around the fixing roller 20 to detect temperature of the fixing roller 20 (fixing temperature). Based on the detection result of thermopile or thermistor, heating amount of the induction heating unit 25 may be adjusted.

A description is given of the pressure roller 30, used as pressure member, with reference to FIG. 2. The pressure roller 30 may include a cylindrical member 32, an elastic layer 31, and a separation layer formed on each other. The cylindrical member 32 may be made from aluminum, cupper, or the like, the elastic layer 31 may be made of silicone rubber, and the separation layer may be made of resin such PFA. The elastic layer 31 may be formed with a given thickness such as from 1 mm to 5 mm. Further, the separation layer may be formed with a given thickness such as from 20 μm to 50 μm. The pressure roller 30 can be pressed and contacted against the fixing roller 20, and the recording medium P is transported through a pressingly contacted portion between the fixing roller 20 and the pressure roller 30, and the pressingly contacted portion may be referred to as the first nip used as the fixing nip. Further, to enhance heating efficiency of the fixing roller 20, a heater 33 such as halogen heater may be disposed in the pressure roller 30, in which when electric power is supplied to the heater 33, radiant heat of the heater 33 can heat the pressure roller 30, and the surface of the fixing roller 20 can be heated using the pressure roller 30.

At a position facing the pressure roller 30 and the upstream from the fixing nip, the entry guide 41 such as plate may be disposed. The entry guide 41 guides the recording medium P to the fixing nip. Further, at a position facing the pressure roller 30 and the downstream from the fixing nip, the guide 50 may be disposed. The guide 50 may be disposed at a position facing a non-fixing face of the recording medium P exiting the fixing nip. When the recording medium P is exiting the fixing nip after conducting the fixing process, the guide 50 guides the recording medium P to the transportation route.

As shown in FIG. 2, at the downstream from the fixing nip (the downstream of transport direction of the recording medium P from the fixing nip), the curling correction unit 70 is disposed. The curling correction unit 70 may apply curling to the recording medium P having a first curling direction after exiting the fixing nip, in which the curling correction unit 70 may apply a second curling direction, which is opposite to the first curling direction of the recording medium P.

Specifically, the curling correction unit 70 may include two rollers such as a metal roller 71 and an elastic roller 72. The metal roller 71 is a metal roller made from carbon steel or the like having a given outside diameter (e.g., 8 mm or so), and a PFA tube having a give a thickness (e.g., 30 μm to 200 μm) may be coated on the metal roller. The elastic roller 72 includes a metal core made from carbon steel or the like having a given outside diameter (e.g., 15 mm or so), and a silicone rubber layer having a give a thickness (e.g., 2 mm to 3 mm) coated on the metal core. Further, a PFA tube having a give a thickness (e.g., 30 μm to 200 μm) may be coated on the silicone rubber layer. When such two rollers 71 and 72 are pressingly contacted, a second nip is formed between the rollers 71 and 72 through which the recording medium P is transported and passed. A shape of the second nip may follow a curvature of the metal roller 71. Further, in FIG. 2, the metal roller 71 may be rotated in a counter-clockwise direction by a driving force caused by a driver such as a motor, and the elastic roller 72 may be rotated in a clockwise direction by a frictional resistance with the metal roller 71 at the second nip, which means the elastic roller 72 is a driven roller driven and rotated by the metal roller 71.

When the recording medium P is exiting the first nip, a curling (back curling) may occur toward a side of the recording medium on which no image is formed (that is, on the side of the pressure roller 30, in which the recording medium P may curl, curve, or warp along a curvature of the pressure roller 30.

When the recording medium P having the back curling is fed to the curling correction unit 70 having the second nip, the second curling direction (or face curling), which is opposite to the back curling, is applied to the recording medium P to offset the back curling, by which curling of the recording medium P can be corrected. In FIG. 2, the curling correction unit 70 is disposed downstream from the guide 50 in the transport direction of the recording medium P. Alternatively, the curling correction unit 70 may be a disposed closer to the first nip.

Further, the fixing unit 19 may include a variable setting unit and a shifting unit, in which the variable setting unit variably sets a face curling amount to be applied to the recording medium P by the curling correction unit 70, and the shifting unit is used to increase or decrease a nip pressure between the fixing roller 20 and the pressure roller 30. In response to the increase/decrease of nip pressure by the shifting unit, the variable setting unit is controlled, which will be described later.

As shown in FIG. 2, the induction heating unit 25 may include a coil unit 26 (exciting coil), a core unit 27 (exciting coil core), and a coil guide 28. The coil unit 26 includes Litz wire, which is a bundle of thin wires, wound and extended in a width direction on the coil guide 28 disposed to cover a part of outer face of the fixing roller 20. The coil guide 28 may be made of a resin material having high thermal resistance, and retains the coil unit 26 by facing with the fixing roller 20. The core unit 27 may be made or ferromagnetic material such as ferrite having relative magnetic permeability of 2500 or so, and may be configured as an arch core, a center core, a side core to form efficient magnetic flux directed to the heating layer of the fixing roller 20.

Such configured fixing unit 19 may be operated as follows. A drive motor drives the fixing roller 20 to rotate the fixing roller 20 in a counter-clockwise direction in FIG. 2, and then the pressure roller 30 is driven and rotated in a clockwise direction. Then the sleeve layer 21 (heating layer) of the fixing roller 20 is heated by magnetic flux generated by the induction heating unit 25 at a position facing the induction heating unit 25.

Specifically, an electronic oscillator circuit flows high frequency alternating current using a power source that can supply variable frequency to the coil unit 26 such as 10 KHz to 1 MHz or 20 KHz to 800 KHz, by which magnetic force can be formed from the coil unit 26 to the sleeve layer 21 of the fixing roller 20 while switching or alternating the direction of magnetic force. By forming such alternating magnetic field, eddy current occurs on the heating layer of the sleeve layer 21, and then Joule heat is generated by electrical resistance of the heating layer, by which induction heating is conducted. As such, the sleeve layer 21 of the fixing roller 20 can be heated by induction heating effect at the heating layer itself.

Then, the surface of fixing roller 20 heated by the induction heating unit 25 comes to a contact portion with the pressure roller 30 (i.e., first nip or fixing nip), and heat and melt a toner image T (toner) on the transported recording medium P. Specifically, after the above described image forming process, the recording medium P carrying the toner image T is fed to the first nip set between the fixing roller 20 and the pressure roller 30 with a guidance of the entry guide 41 (or the roll 42), which is shown by an arrow Y1 showing a transport direction.

Then, the toner image T is fused on the recording medium P using heat of the fixing roller 20 and pressure of the pressure roller 30, and the recording medium P is exiting the first nip of the fixing roller 20 and the pressure roller 30. The recording medium P exiting the first nip is guided to the second nip of the curling correction unit 70 using the guide 50. After the curling correction is conducted, the recording medium P is exiting the curling correction unit 70 which is shown by an arrow Y2 showing a transport direction. Meanwhile, the surface of fixing roller 20 passing through the first nip comes to the position facing the induction heating unit 25 again. Such a series of processing is continuously repeated, by which the fixing process in the image forming process ends.

Figure 3:
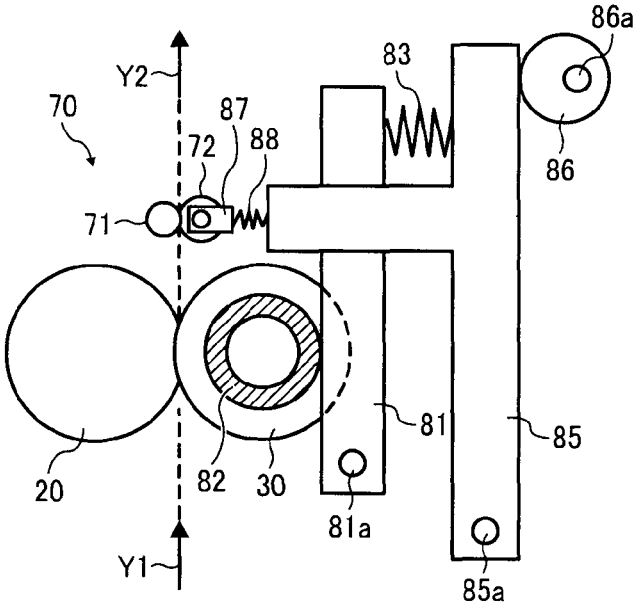
FIG. 3 shows a shifting unit and variable setting unit employed with the fixing unit of FIG. 2.
Figure 4:
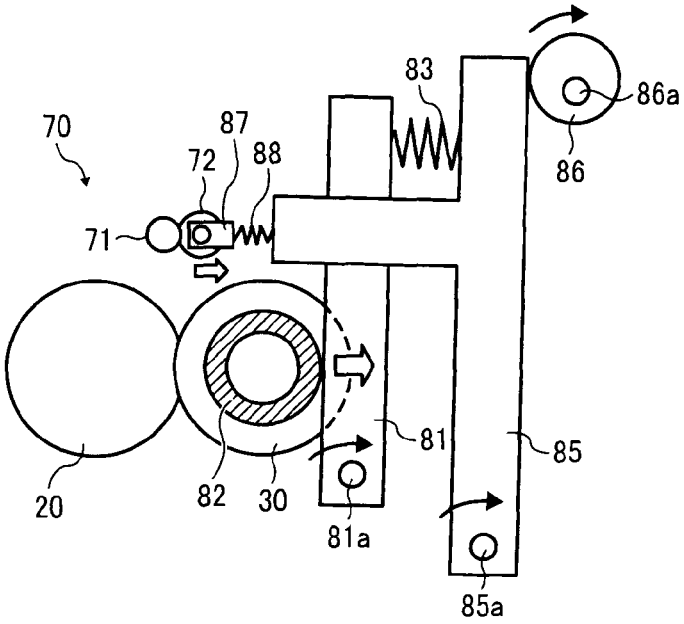
FIG. 4 shows an example condition when a nip pressure in the fixing unit of FIG. 3 is reduced or decreased.
Figure 5:
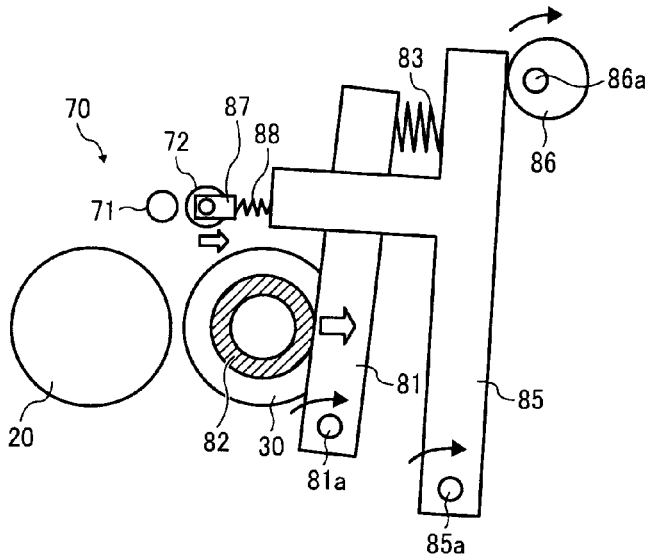
FIG. 5 shows an example condition when a pressure roller is separated in the fixing unit of FIG. 3.
Figure 6:
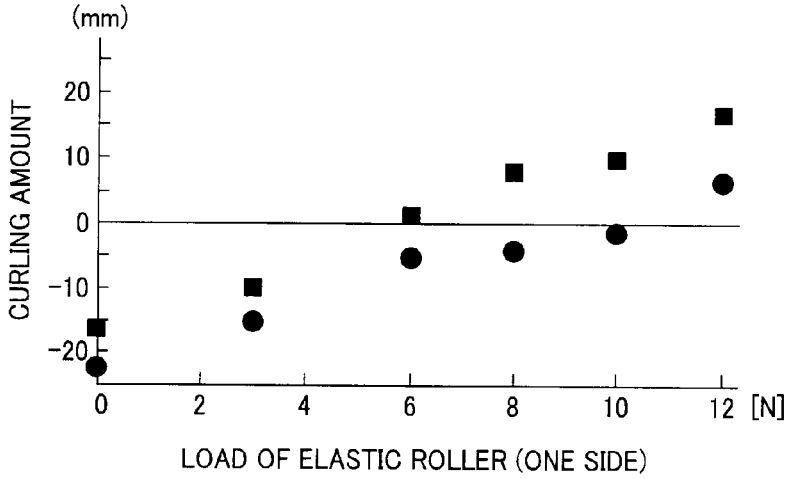
FIG. 6 is a graph indicating a relation between elastic roller load and recording medium curling amount at different nip pressures.

A description is given of configuration and operation of the fixing unit 19 according to an example embodiment with reference to FIGS. 3 to 6. FIG. 3 shows a schematic configuration of the shifting unit and the variable setting unit in the fixing unit 19. FIG. 4 shows a condition when the nip pressure is reduced or decreased in the fixing unit 19 of FIG. 3. FIG. 5 shows a condition when a pressure roller is separated in the fixing unit 19 of FIG. 3. Further, FIG. 6 shows a graph of relation of the load of elastic roller 72 and curling amount at different nip pressures.

As shown in FIGS. 3 to 5, the fixing unit 19 has a shifting unit to move the pressure roller 30 with respect to the fixing roller 20, and a variable setting unit to variably set a curling amount to be applied to the recording medium P. The shifting unit includes shifting devices 81, 83, 85, 86 to move the pressure roller 30 with respect to the fixing roller 20 to increase or decrease pressure at the first nip (nip pressure). The variable setting unit includes variable setting devices 85, 86, 88 to variably set a curling amount to be applied to the recording medium P by the curling correction unit 70, wherein the curling amount is an amount of curling in a second direction opposite to the first curling direction of the recording medium P exiting the first nip. As shown in FIG. 3, some devices, such as devices 85 and 86, may be used, for example, for both of the shifting unit and variable setting unit.

As for the metal roller 71 and the elastic roller 72, the variable setting devices 85, 86, 88 move the elastic roller 72 to increase or decrease a contact pressure of the two rollers 71 and 72 (nip pressure at the second nip). Then, in response to the nip pressure increased or decreased by the shifting devices 81, 83, 85, 86, the variable setting devices 85, 86, 88 variably set the second curling direction amount, which is the opposite direction of first curling amount.

Specifically, the variable setting devices 85, 86, 88 may be controlled as follows: the greater the increase/decrease of nip pressure by the shifting devices 81, 83, 85, 86, the greater the second curling direction amount, opposite direction of first curling amount, by the variable setting devices 85, 86, 88. Conversely, the smaller the increase/decrease of nip pressure by the shifting devices 81, 83, 85, 86, the smaller the second curling direction amount, opposite direction of first curling amount, by the variable setting devices 85, 86, 88.

Furthermore, in the example embodiment, a relative movement of the pressure roller 30 by the shifting unit, and a relative movement of the elastic roller 72 by the variable setting unit, can be conducted interlockingly by one drive source that drives an eccentric cam 86.

As shown in FIG. 3, at each end of width direction of the fixing unit 19, a first lever 81, a second lever 85, the eccentric cam 86, and two compression springs 83 and 88 may be disposed as the shifting devices or variable setting devices.

The first lever 81 is pivotable about a support shaft 81*a* fixed to a side plate of the fixing unit 19. Further, one end of the first lever 81 is connected to the compression spring 83, and the center side of the first lever 81 may be contacted to a ball bearing 82 used for a shaft of the pressure roller 30. One end of the compression spring 83, connected to the one end of the first lever 81, is connected to one end of the second lever 85. Further, in the state shown in FIG. 3, when a force from the one side of 100 Newtons (100 N) is applied to the first lever 81 by the compression spring 83, a force from the one side of 300 N is applied to the pressure roller 30 by the first lever 81 having a leverage ratio of three (3).

The second lever 85 is pivotable about a support shaft 85*a* fixed to a side plate of the fixing unit 19. Further, one end of the second lever 85 contacts the eccentric cam 86, and the compression spring 88 is connected to the center side of the second lever 85. One end of the compression spring 88, connected to the center side of the second lever 85, is connected to a plain bearing 87 which rotatably supports a shaft of the elastic roller 72. Further, in the state shown in FIG. 3, a force from the one side of 10 N is applied to the elastic roller 72 by the compression spring 88, for example.

The eccentric cam 86 has a rotation shaft 86*a*, which is connected to a stepping motor via a series of gears. When the stepping motor is driven, the eccentric cam 86 rotates about the rotation shaft 86*a*, by which the first lever 81 and the second lever 85 can interlockingly pivot. With such a configuration, the nip pressure of the fixing roller 20 and the pressure roller 30 (nip pressure of the first nip), and the nip pressure of the metal roller 71 and the elastic roller 72 (nip pressure of the second nip), can be interlockingly increased or decreased. Further, pulse control of the stepping motor connected to the rotation shaft 86*a* is conducted using an encoder, by which a rotation direction or angle of the eccentric cam 86 can be controlled.

Specifically, as shown in FIG. 3, when a rotation direction or angle of the eccentric cam 86 is controlled so that the top dead center of the eccentric cam 86 contacts the second lever 85, the second lever 85 is moved to a closest position to the elastic roller 72, and the first lever 81 is moved to a closest position to the pressure roller 30. Accordingly, when the nip pressure at the first nip of the fixing roller 20 and the pressure roller 30 reaches its maximum, the nip pressure at the second nip in the curling correction unit 70 reaches its maximum.

Such condition may be effective when the type of recording medium P transported to the first nip is not particularly suitable for fixing performance (for example, the recording medium is relatively thick paper), or when the image area ratio is relatively high for the toner image fused on the recording medium P transported to the first nip (for example, a solid black image is formed). In such a case, by setting a greater value for the nip pressure at the first nip, the fixing performance of an output image can be enhanced. By setting a greater value for the nip pressure at the first nip, a greater curling is more likely to occur to the recording medium P exiting the first nip, and thereby a curling correction amount at the curling correction unit 70 (the nip pressure at the second nip) may be set to a greater value.

Furthermore, as shown in FIG. 4, when the eccentric cam 86 is rotated 90 degrees from the position shown in FIG. 3, the second lever 85 is moved away from the elastic roller 72 (separated or distanced position) from the condition of FIG. 3, and the first lever 81 is moved away from the pressure roller 30 (separated or distanced position) from the condition of FIG. 3. Accordingly, the nip pressure at the first nip of the fixing roller 20 and the pressure roller 30 can be reduced or decreased, and the nip pressure at the second nip in the curling correction unit 70 can be also reduced or decreased. Further, in the state shown in FIG. 4, a force from the one side of 150 N is applied to the pressure roller 30, and a force from the one side of 6 N is applied to the elastic roller 72. Such condition may be effective when the type of recording medium P transported to the first nip is suitable for fixing (for example, relatively thin paper used as the recording medium), or when the image area ratio is relatively small for toner image fused on the recording medium P transported to the first nip (for example, image area ratio of 5% or so is formed). In such a case, by setting a smaller value for the nip pressure at the first nip, a condition sufficient for good fixing performance of an output image and preventing fixing failure such as hot offset can be devised. By setting a smaller value for the nip pressure at the first nip, curling may be less likely to occur to the recording medium P exiting the first nip, and thereby a curling correction amount at the curling correction unit 70 (the nip pressure at the second nip) may be set to a smaller value.

As such, the first lever 81, the compression spring 83, the second lever 85, and the eccentric cam 86 may function as the shifting unit to increase or decrease the nip pressure at the fixing roller 20 and the pressure roller 30. Further, the second lever 85, the eccentric cam 86, the compression spring 88 may function as the variable setting unit to variably set a second curling amount to be applied to the recording medium P by the curling correction unit 70. Further, because the shifting devices 81, 83, 85, 86 and the variable devices 85, 86, 88 can be interlockingly controlled by one drive source such as the stepping motor to drive the eccentric cam 86, the cost reduction of apparatus and the compact in size of apparatus can be devised.

Further, in the above-described explanation, the adjustment of the nip pressure and the curling correction amount are conducted in two steps (the conditions of FIGS. 3 and 4). Furthermore, by controlling the position of the eccentric cam 86 in the rotation direction into several steps, the adjustment of the nip pressure and the curling correction amount can be conducted by multi-steps.

Further, controls of the above-described shifting devices 81, 83, 85, 86 and the variable devices 85, 86, 88, controlled by controlling a rotation position of eccentric cam 86, may be preferably conducted in response to, for example, types of recording medium P and/or image area ratio of the fused image. Specifically, the type (such as thickness) of recording medium P can be determined using detection information of a sheet thickness detector disposed at the sheet feeder 7 or the transportation route of recording medium P, or input information input from an operation panel of the image forming apparatus 1 by a user. Then, based on such information, the nip pressure and curling correction amount may be controlled to a preferable value. Further, the image area ratio of fused image can be determined using image data (or writing data) to be written to the photoconductors 11Y, 11M, 11C, 11K by laser beams emitted from the writing unit. Then, based on such information, the nip pressure and curling correction amount may be controlled to a preferable value. With such control, the fixing performance of output image can be constantly at a good enough level and curling may not occur to the recording medium P ejected from the image forming apparatus 1 for various types of recording medium P and/or various image area ratio of fused image When the recording medium P in transportation is stopped in the first nip (e.g., when sheet-jamming occurs), the shifting devices 81, 83, 85, 86 are configured to decrease the nip pressure automatically or manually so that the stacked recording medium P can be removed. Then, by interlocking the pressure decreasing operation of the shifting devices 81, 83, 85, 86, the variable setting devices 85, 86, 88 are also configured to decrease the contact pressure at the second nip of the two rollers 71 and 72.

Specifically, as shown in FIG. 5, when the eccentric cam 86 is rotated and the bottom dead center of the eccentric cam 86 contacts the second lever 85, the second lever 85 is moved away from the elastic roller 72 to a farthest position, and the first lever 81 is moved away from the pressure roller 30 to a farthest position therefrom. In such a condition, the pressure roller 30 can be separated from the fixing roller 20, and the elastic roller 72 can be also separated from the metal roller 71. In such a state, the nip pressure at the first nip of the fixing roller 20 and the pressure roller 30 becomes zero, and the nip pressure at the second nip in the curling correction unit 70 also becomes zero.

When the recording medium P is jammed and is stopped at the first nip, such separated condition can be set, and an operator such as a user or a customer service representative can remove the recording medium P from the fixing unit 19. In this state, the nip pressure at the first nip of the fixing roller 20 and the pressure roller 30, and the nip pressure at the second nip in the curling correction unit 70 is also decreased, in particular decreased to zero, by which the jammed recording medium P can be easily removed without resistance such as resistance from devices.

Further, when the sheet jamming occurs to the recording medium P in the fixing unit 19, the eccentric cam 86 at the normal condition (conditions of FIG. 3 and FIG. 4) in the fixing unit 19 needs to be rotated to the condition of FIG. 5. Such rotation movement of the eccentric cam 86 can be conducted as follow: a sheet jamming detector disposed near the fixing unit 19 detects sheet jamming of the recording medium P, then based on the detection result, the stepping motor can be automatically controlled to drive and rotate the eccentric cam 86. Further, such rotation movement of the eccentric cam 86 can be conducted using a different configuration as follows: an operator manually opens a body cover of apparatus for removing sheet jamming of the recording medium P, in which rotation movement of the eccentric cam 86 can be interlockingly conducted when the body cover is opened by devising a given configuration.

With reference to FIG. 6, a description is now given of the effect of the configuration described above using FIGS. 3 and 4. In FIG. 6, the horizontal axis indicates load from the one side of the elastic roller 72 in the curling correction unit 70, and the vertical axis indicates curling amount of the recording medium P, in which positive values denote face curling (second curling direction) and negative values denote the back curling (first curling direction).

Further, in FIG. 6, the solid circle (●) indicates curling amount when the nip pressure of the fixing roller 20 and the pressure roller 30 is high, such as 300 N, (the state shown in FIG. 3), and the solid square (■) indicates curling amount when the nip pressure of the fixing roller 20 and the pressure roller 30 is low, such as 150 N (the state shown in FIG. 4). As shown in FIG. 6, the greater the nip pressure of the fixing roller 20 and the pressure roller 30, the greater the back curling amount. Further, the greater the load on the elastic roller 72, the greater the face curling amount. Accordingly, it is preferable to control an increase or decrease of the nip pressure at the metal roller 71 and the elastic roller 72 by matching with the nip pressure to the increase or decrease of the nip pressure of the fixing roller 20 and the pressure roller 30.

Further, the final curling amount of the recording medium P can be set to substantially zero by setting a given combination for the nip pressure of the fixing roller 20 and the pressure roller 30 and the load of the elastic roller 72. For example, as shown in FIG. 6, when the nip pressure of the fixing roller 20 and the pressure roller 30 is 300 N and the load of the elastic roller 72 is set to 10 N, the curling amount becomes substantially zero. Conversely, when the nip pressure of the fixing roller 20 and the pressure roller 30 is 150 N and the load of the elastic roller 72 is set to 6 N, the curling amount becomes zero. As can be appreciated by those skilled in the art, other values between and beyond those described above may be set for pressure or the like depending on the specific configuration of the apparatus.

In the above described example embodiment, even when the first nip pressure is increased or decreased, in response to the increased or decreased first nip pressure, the second curling direction amount applied to the recording medium P, the opposite direction of first curling direction amount, can be variably set, by which curling occurred to the recording medium P exiting the first nip can be uniformly corrected.

Further, in the above described example embodiment, the fixing unit 19 uses an electromagnetic induction heating system having the coil unit 26 (exciting coil) as a heating device. However, the above described example embodiment can be applied to any types of fixing unit using a heater as the heating device in an image forming apparatus of electrophotography.

Further, in the above described example embodiment, the fixing roller 20 is used as the fixing member and the pressure roller 30 is used as the pressure member in the fixing unit. However, other member can be used as the fixing member and the pressure member. For example, a fixing belt or a fixing film may be used as the fixing member, and a pressure belt and a pressure pad can be used as the pressure member for the fixing unit for the above described example embodiment.

Further, in the above described example embodiment, the first nip formed by the fixing roller 20 and the pressure roller 30 is configured to follow the curvature of the pressure roller 30 in the fixing unit 19. However, the first nip formed by the fixing roller 20 and the pressure roller 30 can be configured to follow the curvature of the fixing roller 20 in the fixing unit 19. In such a case, the first curling direction of the recording medium P exiting the first nip is the opposite direction of the first curling direction described in the above described example embodiment, in which the second curling direction to be applied to the recording medium P by the curling correction unit 70 needs to be set to the opposite direction of the second curling direction described in the above described example embodiment. Specifically, the position of the metal roller 71 and the elastic roller 72 may be reversed. In such a case too, the effect of an example embodiment can be similarly attained.

Further, in the above described example embodiment, the shifting unit is configured to move the pressure roller 30, but the shifting unit can be configured to move the fixing roller 20 instead. Further, in the above described example embodiment, the variable setting unit is configured to move the elastic roller 72, but the variable setting unit can be configured to move the metal roller 71 instead. In such a case too, the effect of an example embodiment can be similarly attained.

In the above described example embodiment, even when the first nip pressure is increased or decreased, in response to the increased or decreased first nip pressure, the second curling direction amount can be variably set, which is the opposite direction of curling applied to the recording medium at the first nip, by which curling occurring to the recording medium exiting the first nip can be uniformly corrected, and such configuration can be applied to fixing units and image forming apparatuses.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A fixing unit, comprising:

a fixing member to fuse a toner image on a recording medium by heating and melting the toner image on the recording medium;

a pressure member to press against the fixing member, to define a first nip, as a fixing nip, between the fixing member and the pressure member through which the recording medium is transported;

a shifting unit to move the pressure member relative to the fixing member to increase or decrease a pressure of the first nip;

a curling correction unit disposed downstream from the first nip in a transport direction of the recording medium that imparts a second curling direction to the recording medium, opposite of a first curling direction of the recording medium exiting the first nip; and a variable setting unit operatively connected to the curling correction unit to variably set an amount of the second curling direction to be applied to the recording medium by the curling correction unit depending on the first nip pressure increased or decreased by the shifting unit, wherein the curling correction unit includes two rollers, separate from the fixing member and pressure member, the two rollers being disposed contactable against each other to form a second nip, as a correction nip, through which the recording medium is transported after exiting the first nip.

2. The fixing unit of claim 1, wherein the variable setting unit controls the second curling direction amount in a way corresponding to a condition of the first nip pressure, wherein when the first nip pressure is increased, the second curling direction amount is increased, and wherein when the first nip pressure is decreased, the second curling direction amount is decreased.

3. The fixing unit of claim 1, wherein the variable setting unit moves at least one of the two rollers of the curling correction unit to increase or decrease a contact pressure at the second nip.

4. The fixing unit of claim 3, further comprising a single drive source that coordinates relative movement of the pressure member by the shifting unit and relative movement of one of the two rollers by the variable setting unit.

5. The fixing unit of claim 3, wherein when the recording medium being in transportation is stopped in the first nip, the shifting unit decreases the first nip pressure automatically or manually so that the recording medium is removed, and interlockingly, the variable setting unit also decreases a contact pressure at the second nip of the two rollers in response to the automatic or manual pressure decreasing operation at the first nip by using the shifting unit.

6. The fixing unit of claim 1, wherein the shifting unit controls an increase or decrease of the first nip pressure in response to at least one of type of recording medium transported to the first nip and an image area ratio of toner image fused on the recording medium transported to the first nip.

7. An image forming apparatus comprising the fixing unit of claim 1.

* * * * *